US008414263B1

(12) United States Patent
Liang

(10) Patent No.: US 8,414,263 B1
(45) Date of Patent: Apr. 9, 2013

(54) TURBINE STATOR VANE WITH NEAR WALL INTEGRATED MICRO COOLING CHANNELS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 13/427,277

(22) Filed: Mar. 22, 2012

(51) Int. Cl.
*F01D 5/18* (2006.01)

(52) U.S. Cl.
USPC ..... 416/96 R; 416/97 R

(58) Field of Classification Search ..... 415/115; 416/96 R, 97 R
See application file for complete search history.

(56) References Cited

U.S. PATENT DOCUMENTS

| | | | | |
|---|---|---|---|---|
| 5,702,232 | A * | 12/1997 | Moore | 416/95 |
| 6,379,118 | B2 * | 4/2002 | Lutum et al. | 416/97 R |
| 6,994,521 | B2 * | 2/2006 | Liang | 416/97 R |
| 8,047,788 | B1 * | 11/2011 | Liang | 416/97 R |
| 2008/0019840 | A1 * | 1/2008 | Cunha | 416/96 R |

* cited by examiner

*Primary Examiner* — Dwayne J White
(74) *Attorney, Agent, or Firm* — John Ryznic

(57) ABSTRACT

A turbine stator vane has different micro sized radial extending cooling channels for each of four regions around the airfoil to provide adequate cooling depending on the external airfoil heat loads. The vane includes collector cavities to supply cooling air to the leading edge region cooling channels and to trailing edge exit holes. The radial cooling channels along the pressure and suction side walls are supplied with cooling air than flows through the endwalls first and then discharges into the collector cavities. The radial cooling channels in the hotter sections of the airfoil include film cooling holes while the radial cooling channels downstream of the airfoil throat have only convection cooling.

16 Claims, 10 Drawing Sheets view A-A view B-B

TURBINE STATOR VANE WITH NEAR WALL INTEGRATED MICRO COOLING CHANNELS

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine, and more specifically to an air cooled turbine stator vane with micro cooling channels.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Pressurized cooling air used to cool both rotor blades and stator vanes is bled off from the compressor and is thus not available for producing useful work such as burning with a fuel to produce a hot gas stream that is passed through the turbine. The more bleed off air used from the compressor for cooling of the airfoils, the lower the efficiency of the engine.

Prior art turbine stator vanes and rotor blades are formed by casting the vanes or blades with the internal cooling air circuit formed during the casting process. Some machining can be used after the casting process such as to form the film cooling holes. An investment casting process uses a ceramic core having the shape of the desired internal cooling circuit. Molten metal is poured around the ceramic core and solidified to form the vane or blade. Because the core is made of a ceramic material, the size of the cooling features is limited to around 1.3 mm in diameter for a cooling air hole. Smaller features would break during the casting process because of the heavy molten metal flowing around the small ceramic features. Also, because of a pulling direction for casting the ceramic mold, complex features in the cooling circuitry cannot be produced. Smaller and more complex cooling air features would allow for improved cooling effectiveness while using less cooling air from the compressor.

BRIEF SUMMARY OF THE INVENTION

A turbine stator vane, especially a first stage stator vane for an industrial gas turbine engine, where the vane includes endwall cooling and airfoil wall cooling with film cooling for the hotter sections of the airfoil. The vane and the cooling channels are formed from a metal printing process in which very small and complex features can be produced that cannot be formed from an investment casting process using a ceramic core.

Micro cooling channels in the leading edge region include impingement cooling followed by film cooling in which the cooling air is supplied from a forward collector cavity. Multiple rows of film cooling holes are connected to the impingement channel.

Micro cooling channels formed along the pressure side wall form alternating radial channels with one being supplied with cooling air through an inner diameter endwall cooling channel first with the other being supplied with outer diameter endwall cooling channels before both radial cooling channels discharging into a collector cavity. Film cooling holes are used in these radial channels for film cooling as well.

A forward section of the suction side wall is formed with an alternating arrangement of radial connection cooling channels connected to impingement cooling channels with film cooling holes. These radial cooling channels are supplied with cooling air that first flows through the inner diameter endwall or the outer diameter endwall.

An aft section of the suction side wall is cooled using radial extending channels with convection cooling only in which an alternating arrangement of radial channels is formed with one having the cooling air supplied through an inner endwall cooling circuit and the other being supplied with cooling air that first flows through the outer endwall. Both radial channels discharge into the aft collector cavity.

A row of trailing edge exit holes are connected to the aft collector cavity to discharge the spent cooling air and cool the trailing edge region.

DETAILED DESCRIPTION OF THE INVENTION

The present invention is a turbine stator vane with a cooling circuit that cannot be formed using the prior art investment casting process but can be formed using a metal printing process in which the vane can be printed instead of cast. The present invention is especially useful for a first stage stator vane used in an industrial gas turbine engine because of its higher cooling effectiveness and because the vane can be formed from a material that cannot be formed from the investment casting process. A metal printing process such as that developed by Mikro Systems, Inc. of Charlottesville, Va. can be used to print a part from a metal with very small cooling air channels and very complex features that cannot be formed from a ceramic core in an investment casting process. The vane of the present invention has different shaped and sized near wall cooling channels for different sections of the airfoil of the vane. The leading edge region of the vane airfoil is exposed to the highest heat load and therefore requires the most cooling capability as well as film cooling. The forward sections of the pressure side wall require a different micro cooling structure than does the suction side wall forward section. The aft section of the suction side wall requires the least amount of cooling and therefore can make use of a simple radial cooling channel without film cooling.

Figure 1:
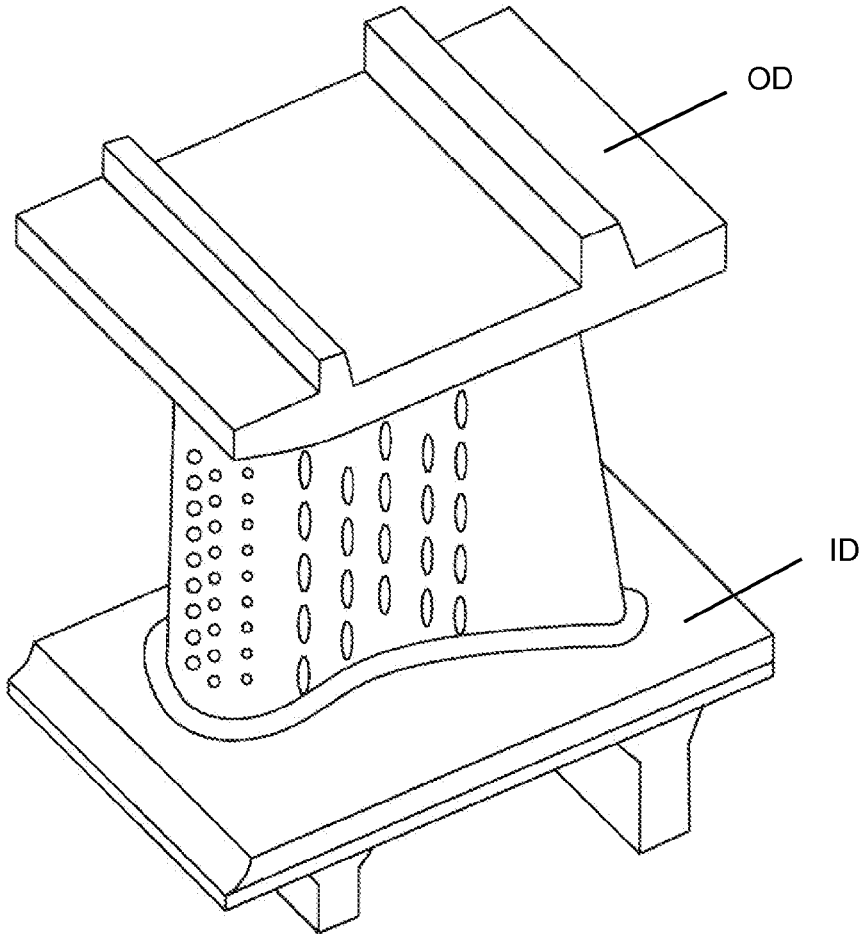
FIG. 1 shows an isometric view of a turbine stator vane with a near wall cooling circuit in which the micro channel cooling circuit of the present invention can be used.
Figure 2:
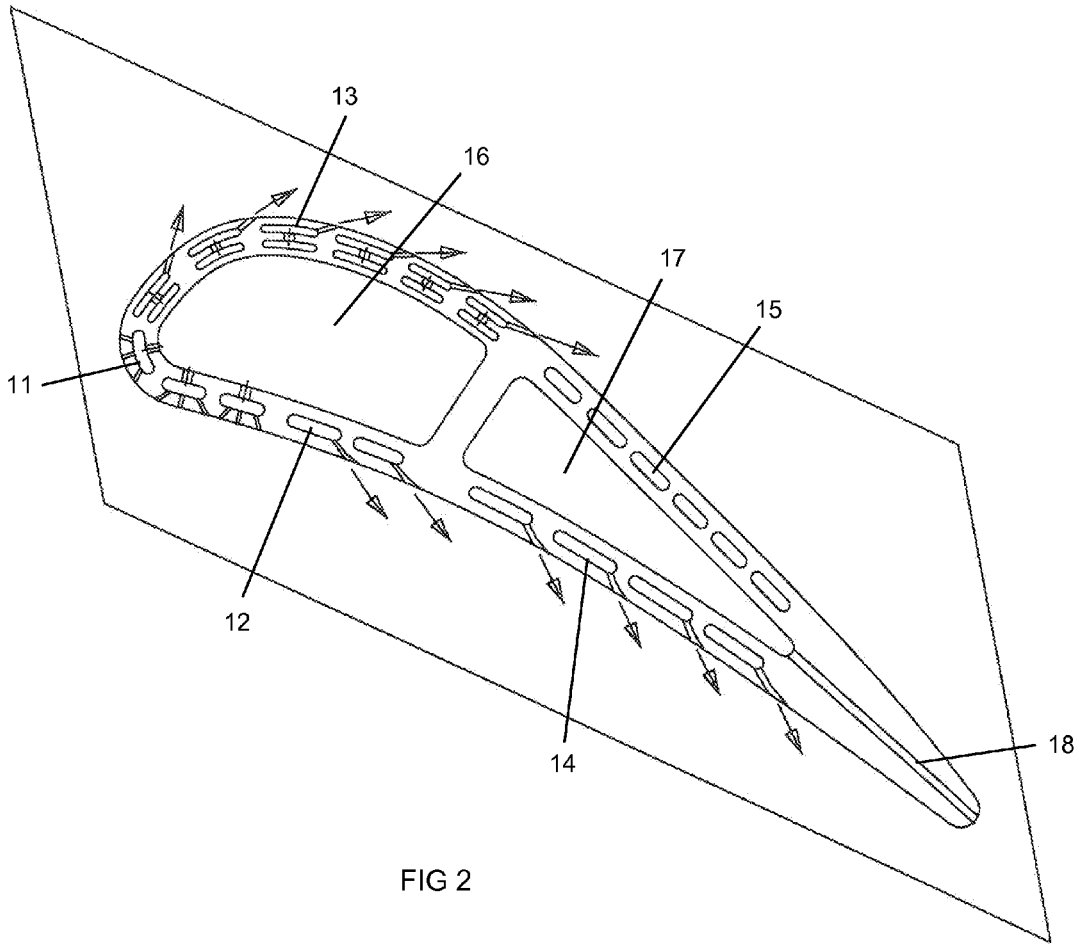
FIG. 2 is a cross section top view of a stator vane with the micro cooling channels and features of the present invention.

FIG. 2 shows a cross section top view of the airfoil section of the vane with the pressure and suction side walls extending between the leading edge and trailing edge regions. A rib extends from the pressure side wall to the suction side wall and separates a forward collector cavity 16 from an aft collector cavity 17. The leading edge region is cooled using micro cooling channels 11 that include a showerhead arrangement of film cooling holes with backside impingement and micro pin fins to enhance the cooling effectiveness. Cooling air for the leading edge region micro cooling channels 11 is supplied from the forward collector cavity 16.

The pressure side wall is cooled using micro cooling channels 12 and 14 that have film slots or film holes. Micro cooling channels 12 and 14 are supplied with cooling air that first flows through cooling channels formed in the outer diameter (OD) endwall or the inner diameter (ID) endwall which is described below. The cooling air discharged from these micro cooling channels 12 and 14 flows into the forward or aft collector cavities 16 or 17.

The forward section of the suction side wall is cooled using micro cooling channels 13 that uses impingement cooling of the backside surface followed by film cooling. Cooling air for these micro cooling channels 13 first flows through the endwall and then discharges into the collector cavity 16.

The aft section of the suction side wall is cooled using micro cooling channels 15 using convection cooling and is supplied with cooling air that flows first through the endwall and is then discharged into the collector cavity 17. Cooling air for the trailing edge exit holes 18 is supplied from the aft collector cavity 17.

Figure 3:
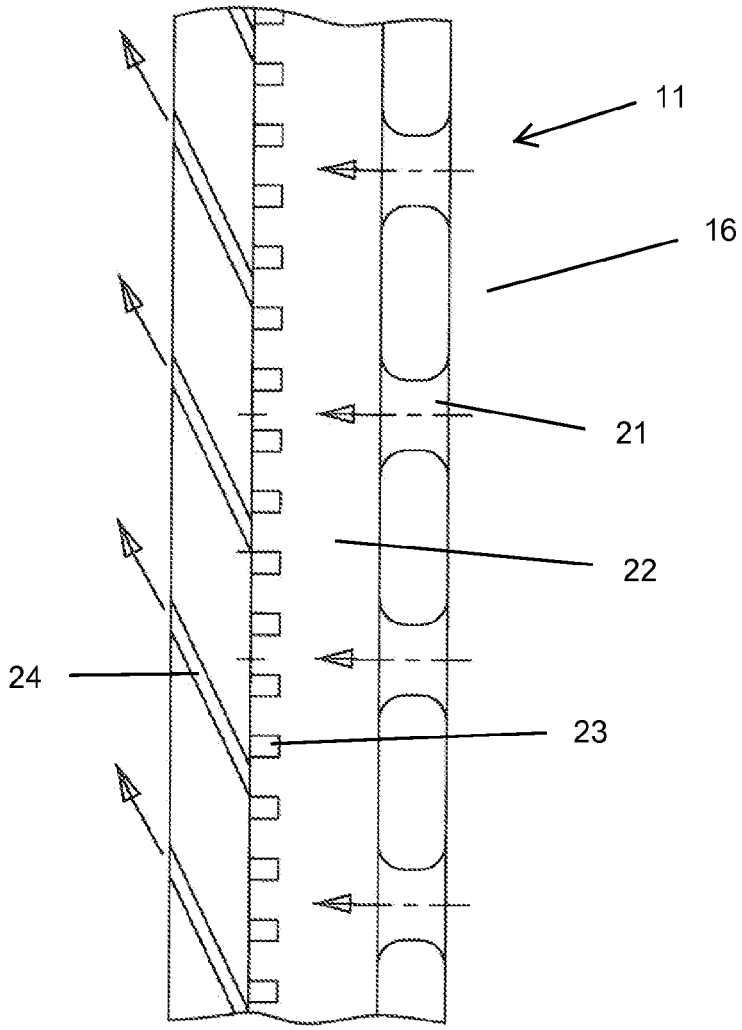
FIG. 3 is a cross section side view of the micro cooling channels and features used in the leading edge region of the vane of the present invention.

FIG. 3 shows a cross section side view of the micro cooling channel 11 used in the leading edge region. The cooling air is supplied from the forward collector cavity 16 and flows through metering and impingement holes 21 into an impingement cavity 22 to provide impingement cooling for the backside surface of the leading edge region wall. Micro pin fins 23 are formed on the backside surface to enhance the convection capability. A showerhead arrangement of film cooling holes 24 discharge film cooling air from the impingement cavity 22. All of these features of the micro cooling channel 11 are formed by the metal printing process so that very small and complex features can be produced that cannot be formed using a ceramic core in an investment casting process. As seen in FIG. 2, three rows of micro cooling channels each having three rows of film cooling holes is used to provide a high level of convection and impingement cooling followed by film cooling for the section of the vane that is exposed to the highest heat load.

Figure 4:
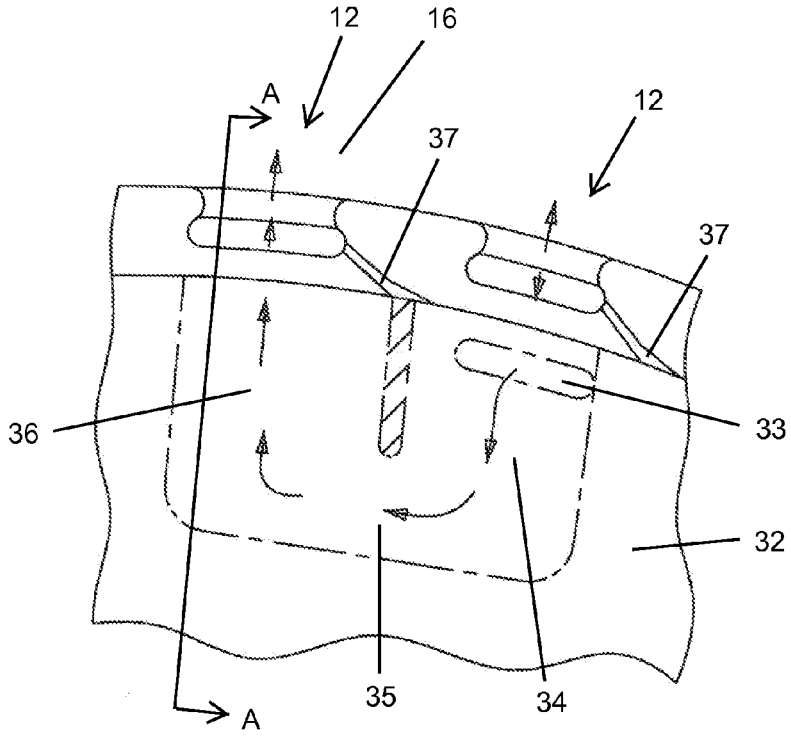
FIG. 4 is a cross section view of the micro cooling channels used in the pressure side wall and inner diameter endwall of the vane of the present invention.
Figure 5:
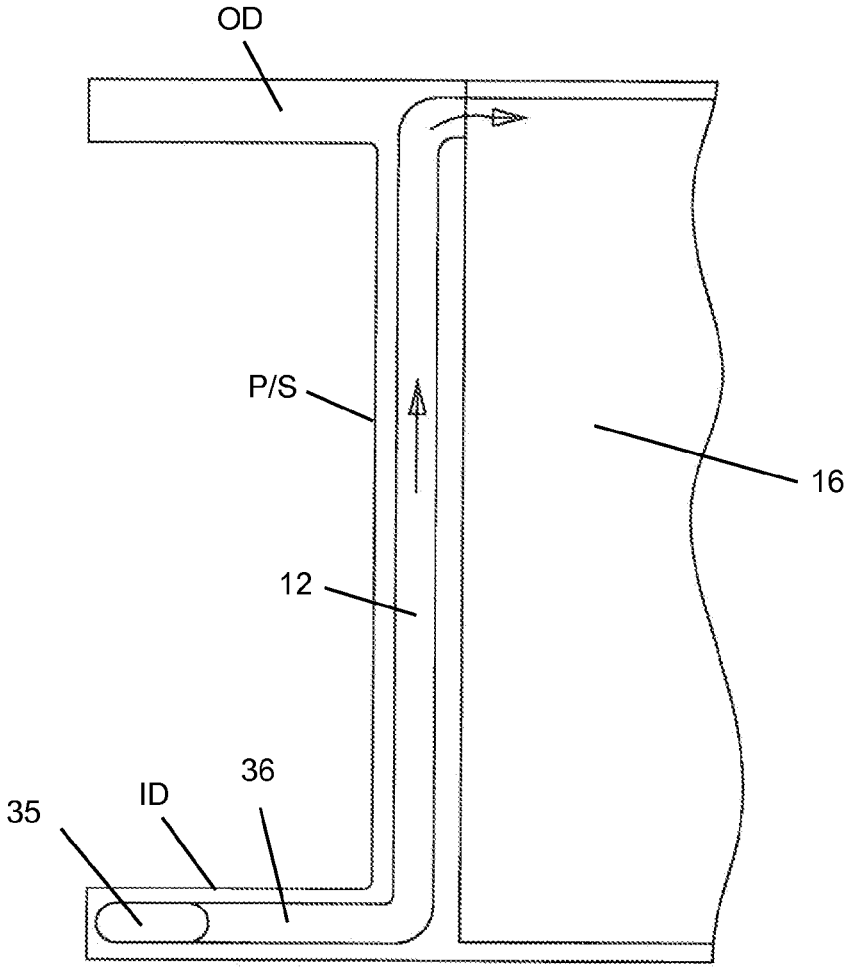
FIG. 5 is a cross section side view of the micro cooling channel through line A-A in FIG. 4.

FIGS. 4 through 9 show the micro cooling channels 12 used to provide cooling for the pressure side wall with an alternating arrangement of radial cooling channels that flow radial inward or radial outward with each discharging film cooling air. FIG. 4 shows a micro cooling channel 12 that also provides cooling for the ID endwall 32. A cooling air feed hole 33 supplies cooling air from below the ID endwall that then flows through channels 34 and 25 and 36 formed within the ID endwall to provide cooling for the ID endwall first. The cooling air from the ID endwall channel 36 then flows into the radial channel formed within the pressure side wall toward the OD endwall. Pressure side film cooling holes 37 discharge some of the cooling air with the remaining cooling air flowing into the collector cavity 16. FIG. 5 shows a cross section side view of the micro cooling channel through the line A-A in FIG. 4. This is referred to as the upward flowing micro cooling channel 12.

Figure 6:
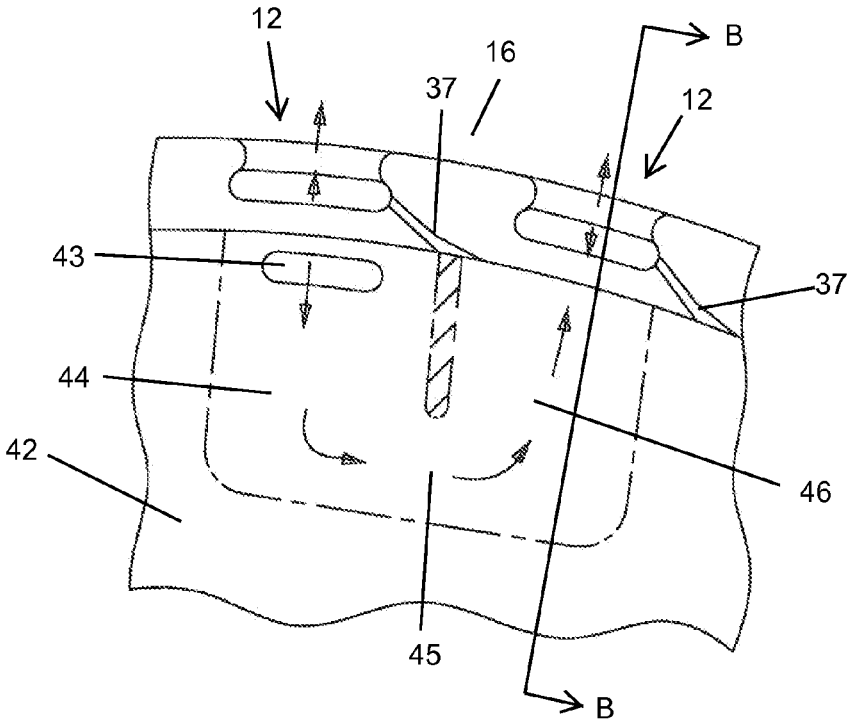
FIG. 6 is a cross section view of the micro cooling channels used in the pressure side wall and outer diameter endwall of the vane of the present invention.
Figure 7:
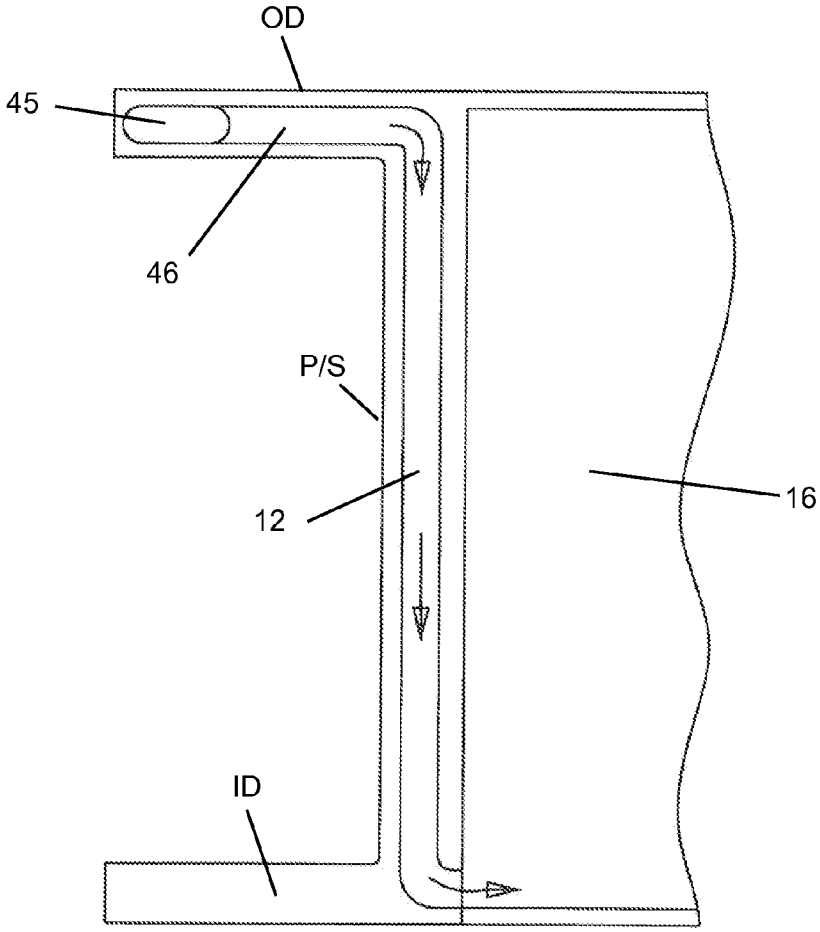
FIG. 7 is a cross section side view of the micro cooling channel through line B-B in FIG. 4.

FIG. 6 shows a downward flowing micro cooling channel 12 in which the OD endwall is cooled first and then the pressure side wall. A cooling air feed hole 43 supplies cooling air from above the OD endwall 42 and into the OD endwall cooling channels 44 and 45 and 46 to provide cooling for the OD endwall. The cooling air from the OD endwall channel 46 then flows through the radial channel formed in the pressure side wall as seen in FIG. 7, discharging into the forward collector cavity 16. Film cooling holes 37 are also connected to the radial channels of these micro cooling channels 12. The micro cooling channels 12 formed along the pressure side wall alternates from radial upward flowing to radial downward flowing.

Figure 8:
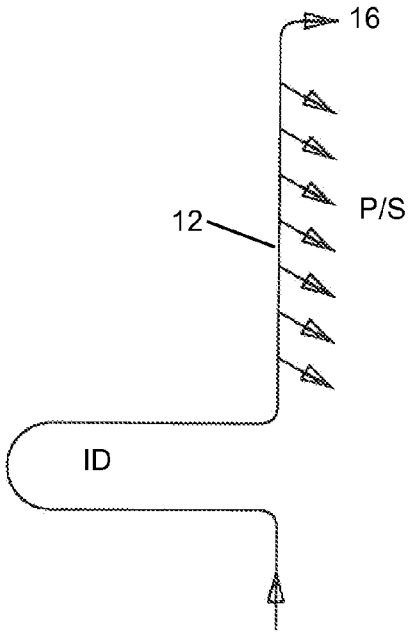
FIG. 8 is a flow diagram for the micro cooling channel used in FIGS. 4 and 5.
Figure 9:
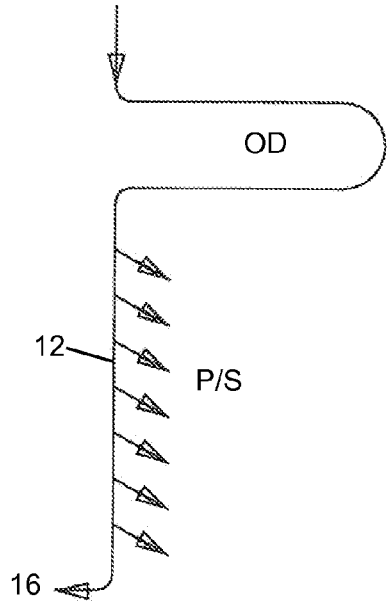
FIG. 9 is a flow diagram for the micro cooling channel used in FIGS. 6 and 7.

FIG. 8 shows a flow diagram for the pressure side wall micro cooling channel that flows through the ID endwall first and then up through the radial channel and then discharges into the forward collector cavity 16. FIG. 9 shows the flow diagram for the pressure side wall micro cooling channel that flows through the OD endwall first and then down through the radial channel and then discharges into the forward collector cavity 16. These two flow diagrams alternate from one to the other along the pressure side wall. The micro cooling channels 12 adjacent to the forward collector cavity 16 will flow into the forward collector cavity 16 while the micro cooling channels 12 adjacent to the aft collector cavity 17 will flow into the aft collector cavity 17.

Figure 10:
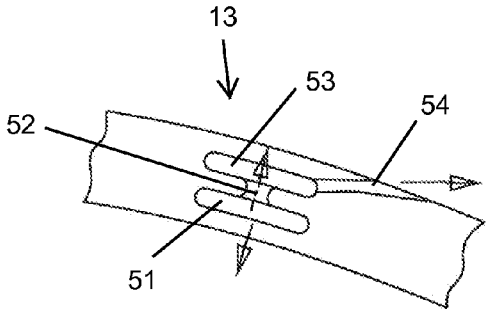
FIG. 10 is a cross section view of the micro cooling channels and features used in the forward section of the suction side wall of the vane of the present invention.
Figure 11:
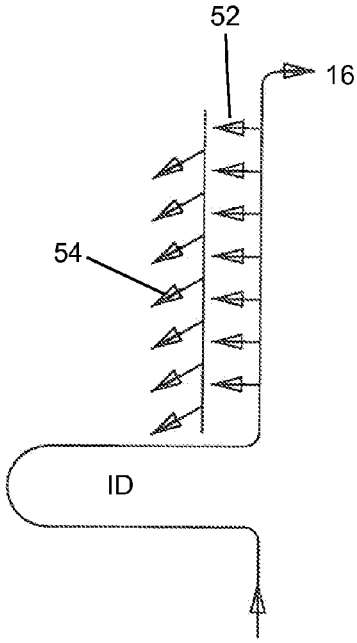
FIG. 11 is a flow diagram for the micro cooling channel of FIG. 10 used to cool the forward suction side wall and the inner diameter endwall.
Figure 12:
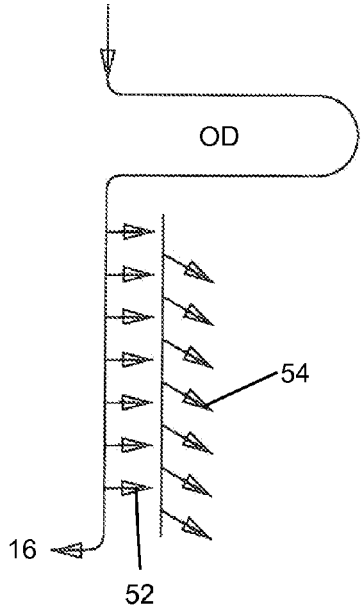
FIG. 12 is a flow diagram for the micro cooling channel of FIG. 10 used to cool the forward suction side wall and the outer diameter endwall.

FIG. 10 shows the micro cooling channel 13 used along the forward section of the suction side wall with an alternating arrangement of upward flowing radial channels (FIG. 11) and downward flowing radial channels (FIG. 12) in which both radial flowing channels discharge film cooling air. The upward flowing micro cooling channels 13 are supplied cooling air through feed holes in the ID endwall that then flow through the ID endwall cooling channels similar to those shown in FIGS. 4 and 6 to provide cooling for the endwall prior to passing through the radial supply channels 51. Once the cooling air enters the radial supply channels 51, the cooling air flows through metering and impingement holes 52 to provide impingement cooling for the backside surface of the suction side wall and into the impingement channels 53. The spent impingement cooling air can flow through film cooling holes 54 to provide film cooling for the suction side wall. Any remaining spent impingement cooling air will flow into the forward collector cavity 16.

The forward section of the suction side wall is cooled using an alternating arrangement of the micro cooling channels 13 that alternate from upward flowing with ID endwall cooling to downward flowing with OD endwall cooling. The FIG. 12 flow diagram shows the cooling air supplied from a feed hole in the OD endwall with cooling of the OD endwall occurring first and then passing along the radial channel in a downward direction. The cooling channels for the FIG. 12 version is the same in FIG. 10 but with a different supply feed hole and direction of flow along the radial supply channel 51 than in the FIG. 11 micro cooling channel 13.

Figure 13:
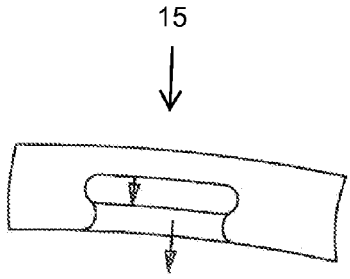
FIGS. 13 and 14 show cross section views of the micro cooling channels used to cool the aft section of the suction side wall of the vane of the present invention.
Figure 14:
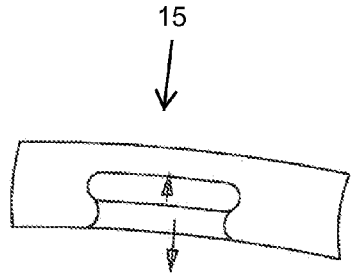
Figure 15:
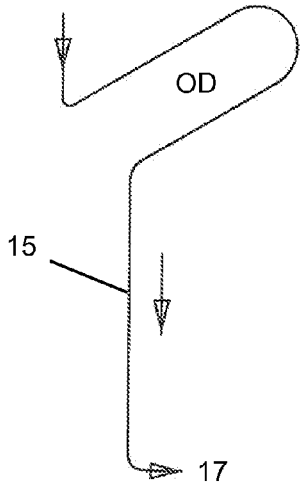
FIG. 15 shows a flow diagram for the micro cooling channel used to cool the aft section suction side wall and the outer diameter endwall.
Figure 16:
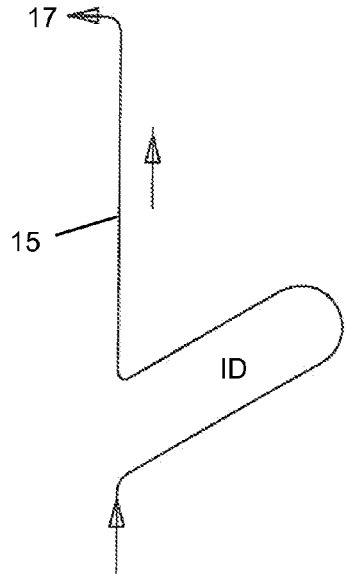
FIG. 16 shows a flow diagram for the micro cooling channel used to cool the aft section suction side wall and the inner diameter endwall.

FIGS. 13 and 14 show the micro cooling channels 15 used to cool the aft section of the suction side wall in which only convection cooling occurs. This section is cooled using an alternating arrangement of radial downward cooling with OD endwall cooling alternating with radial upward cooling with ID endwall cooling. FIG. 15 shows a micro cooling channel 15 with a feed hole in the OD endwall that flows first through the OD endwall cooling channels like those in FIGS. 4 and 6 to provide OD endwall cooling first followed by radial flow through the channel 15 toward the ID endwall that is discharged into the aft collector cavity 17. FIG. 16 shows the flow diagram for the micro cooling channel 15 that flows through the ID endwall first and then upward through the radial channel 15 and then discharges into the aft collector cavity 17. In both micro cooling channels 15, the cooling air flows first through the respective endwall to provide convection cooling for the endwall, and then through the radial channels 15 to provide convection cooling for the suction side wall of the airfoil discharging into the aft collector cavity 17. No film cooling is allowed because this section of the airfoil is exposed to a relatively high mainstream gas flow velocity. Ejection of the film cooling air would induce an aerodynamic mixing loss and thus reduce the turbine performance.

The vane with the airfoil extending between the ID and OD endwalls and the micro cooling channels and features can all be formed using the metal printing process so that very small cooling channels and features can be formed that cannot be produced using the ceramic core with investment casting. Because of the complex features and small diameters of the cooling channels used in the present invention, more effective cooling can be produced so that less cooling air is required. Therefore, the gas turbine engine efficiency can be increased.

Because the vane of the present invention is formed not from an investment casting process using a ceramic core but from a metal printing process, the vane can be formed from MA754 which is an Oxidized Dispersed Strengthened (ODS) high temperature oxidation and erosion resistant material. A vane made from this material will have a longer useful life because of the resistance to oxidation or erosion. This MA754 material is in a powder form and thus the vane cannot be cast using investment casting. The vane can be formed from this powdered material using the metal printing process.

I claim the following:

1. A turbine stator vane comprising:

an airfoil extending between an outer diameter endwall and an inner diameter endwall;

a forward cooling air collector cavity and an aft cooling air collector cavity;

a first radial extending cooling channel formed in a leading edge region wall of the airfoil;

the first radial extending cooling air channel forming impingement cooling followed by film cooling a second radial extending cooling channel formed in a pressure side wall of the airfoil;

the second radial extending cooling channel having endwall cooling followed by film cooling;

a third radial extending cooling channel formed in a forward section of a suction side wall of the airfoil;

the third radial extending cooling channel having convection cooling followed by impingement cooling followed by film cooling;

a fourth radial extending cooling channel formed in an aft section of the suction side wall of the airfoil; and, the fourth radial extending cooling channel having convection cooling only followed by discharge into the aft cooling air collector cavity.

2. The turbine stator vane of claim 1, and further comprising:

the second and third radial extending cooling channels discharge any remaining cooling air into one of the cooling air collector cavities.

3. The turbine stator vane of claim 1, and further comprising:

the first radial extending cooling channel includes a radial extending impingement channel connected to the forward collector cavity through a row of metering and impingement holes; and, the first radial extending cooling channel is connected to a plurality of rows of film cooling air holes.

4. The turbine stator vane of claim 3, and further comprising:

a backside surface of the radial extending impingement channel includes a plurality of micro sized pin fins.

5. The turbine stator vane of claim 1, and further comprising:

the second radial extending cooling channel includes an alternating arrangement of radial extending cooling channels supplied with cooling air from the inner diameter endwall or the outer diameter endwall.

6. The turbine stator vane of claim 5, and further comprising:

the second radial extending cooling channels adjacent to the forward collector cavity discharges into the forward collector cavity; and, the second radial extending cooling channels adjacent to the aft collector cavity discharges into the aft collector cavity.

7. The turbine stator vane of claim 1, and further comprising:

the third radial extending cooling channel includes an alternating arrangement of radial extending cooling channels supplied with cooling air from the inner diameter endwall or the outer diameter endwall.

8. The turbine stator vane of claim 1, and further comprising:

the third radial extending cooling channel includes a radial extending cooling air supply channel located adjacent to a cool surface of the suction side wall and a radial extending impingement channel located adjacent to a hot surface of the suction side wall; and, a row of metering and impingement holes connecting the radial extending supply channel to the radial extending impingement channel.

9. The turbine stator vane of claim 1, and further comprising:

a row of exit holes connected to the aft collector cavity and opening onto a trailing edge of the airfoil.

10. The turbine stator vane of claim 1, and further comprising:

the fourth radial extending cooling channel includes a plurality of radial extending cooling channels alternating between inner diameter endwall cooling and outer diameter endwall cooling prior to cooling of the airfoil wall.

11. The turbine stator vane of claim 1, and further comprising:

the endwall cooling includes a feed hole to supply cooling air from outside of the endwall and into a first endwall cooling channel that turns and flows into a second endwall cooling channel prior to flowing into the radial extending cooling channel.

12. The turbine stator vane of claim 1, and further comprising:

the first and second and third and fourth radial extending cooling channels are micro cooling channels that are too small to be formed from an investment casting process that uses a ceramic core.

13. The turbine stator vane of claim 1, and further comprising:

the second and third and fourth radial extending cooling channels are each formed without trip strips or pin fins.

14. The turbine stator vane of claim 1, and further comprising:

the stator vane and the radial extending cooling channels are formed from a high temperature oxidation and erosion resistant powder material.

15. The turbine stator vane of claim 14, and further comprising:

the powder material is an Oxidized Dispersed Strengthened material.

16. The turbine stator vane of claim 15, and further comprising:

the Oxidized Dispersed Strengthened material is MA754.

* * * * *